US012453914B2

(12) United States Patent
Mitchell et al.

(10) Patent No.: US 12,453,914 B2
(45) Date of Patent: Oct. 28, 2025

(54) MODULAR TRAINING SYSTEM

(71) Applicant: Posi-Trak, Inc., Knoxville, TN (US)

(72) Inventors: Marty Mitchell, Friendsville, TN (US); Paul Hahn, Burlington (CA)

(73) Assignee: Posi-Trak, Inc., Knoxville, TN (US)

( * ) Notice: Subject to any disclaimer, the term of this patent is extended or adjusted under 35 U.S.C. 154(b) by 188 days.

(21) Appl. No.: 18/119,318

(22) Filed: Mar. 9, 2023

(65) Prior Publication Data

US 2023/0285833 A1 Sep. 14, 2023

Related U.S. Application Data

(60) Provisional application No. 63/318,922, filed on Mar. 11, 2022.

(51) Int. Cl.
*A63B 71/02* (2006.01)

(52) U.S. Cl.
CPC ..... *A63B 71/023* (2013.01); *A63B 2225/093* (2013.01)

(58) Field of Classification Search
CPC ..... A63B 71/023; A63B 2225/093; A63B 21/0628; A63B 21/078; A63B 21/4029; A63B 21/4034; A63B 2071/026; A63B 2071/0694; A63B 2208/0233; A63B 2225/10; A63B 1/00; A63B 17/04; A63B 2210/50; A63B 2225/09
See application file for complete search history.

(56) References Cited

U.S. PATENT DOCUMENTS

| | | | | |
|---|---|---|---|---|
| 5,306,220 | A * | 4/1994 | Kearney | A63B 23/00 482/99 |
| 5,556,064 | A * | 9/1996 | Cowe | F16M 11/24 248/172 |
| 6,348,028 | B1 | 2/2002 | Cragg | |
| 7,922,628 | B2 * | 4/2011 | Gonzalez | A63B 69/22 482/90 |
| 8,814,756 | B2 * | 8/2014 | Todokoro | A63B 9/00 482/35 |
| 10,576,322 | B2 * | 3/2020 | Schlegel | A63B 23/1227 |

(Continued)

OTHER PUBLICATIONS

Patent Cooperation Treaty, International Searching Authorities, International Search Report and Written Opinion for PCT Application PCT/US2023/014910, Form PCT/ISA/220, Date of Mailing: Oct. 31, 2023.

*Primary Examiner* — Andrew M Kobylarz
(74) *Attorney, Agent, or Firm* — Luedeka Neely, P.C.

(57) ABSTRACT

A modular strength training equipment system for providing a plurality of equipment options. The system includes a plurality of base components for forming a plurality of customizable base configurations. The plurality of base components includes a plurality of posts, a plurality of stabilization legs, and a plurality of junction boxes. Each of the plurality of junction boxes include a base receiver, a vertical receiver, and one or more horizontal receivers for removably receiving and arranging the plurality of posts and the plurality of stabilizing legs into the plurality of customizable base configurations. The system further includes a plurality of function mounts that are each configured to be selectively secured to at least one of the plurality of customizable base configurations based on a desired equipment option of a user.

10 Claims, 7 Drawing Sheets

(56) References Cited

U.S. PATENT DOCUMENTS

| | | | | |
|---|---|---|---|---|
| 11,707,662 | B1 * | 7/2023 | Schroeder | A63B 71/02 52/126.6 |
| 2010/0160093 | A1 * | 6/2010 | MacArthur | A63B 69/0071 473/447 |
| 2013/0065738 | A1 | 3/2013 | Henniger et al. | |
| 2014/0128231 | A1 | 5/2014 | Menaker | |
| 2016/0136472 | A1 | 5/2016 | Kwo | |
| 2019/0388721 | A1 * | 12/2019 | Schlegel | A63B 69/34 |
| 2020/0197776 | A1 * | 6/2020 | Gonzalez | A63B 69/0013 |

* cited by examiner

MODULAR TRAINING SYSTEM

CROSS REFERENCE TO RELATED APPLICATION

This application claims priority to U.S. Provisional Application Ser. No. 63/318,922 filed Mar. 11, 2022, entitled "Modular Training System," the entire contents of which is incorporated herein by reference.

FIELD

The present disclosure is directed to a modular strength training equipment system. More specifically, the present disclosure is directed to a modular system that is customizable to provide a variety of different pieces of specialized strength training equipment using the same core components in combination with different function mounts.

BACKGROUND

A good weight training and exercise gym/facility will offer many different types of exercise equipment. Much of the equipment is highly specialized such that separate equipment is intended to be used to perform as little as one specific exercise. While offering many different equipment options is highly desirable, it is often difficult to provide a complete facility due to budget and space limitations. This is particularly true for gyms and facilities that are not used by as many people and/or have limited budgets such as home gyms and high school weight rooms.

While many different types of multi-station machines, all-in-one systems, exercise racks, etc. are commercially available that try to combine as many types of exercises as possible into a single piece of equipment (hereinafter referred to as an "all-in-one system"), these systems still suffer various drawbacks. For example, most all-in-one systems allow for one user at a particular time. Thus, for locations in which there are intended to be multiple users of the equipment (e.g., a high school gym during team workouts), multiple all-in-one systems would still need to be purchased. Further, all-in-one systems are typically focused on providing for the more popular/common strength training exercises. Accordingly, to perform less common strength exercises that require specialized equipment, additional stand-alone type equipment will still need to be purchased. Yet another disadvantage associated with many all-in-one systems is that the weight stack is generalized for each of the types of exercises available to the system instead of being matched to the user and/or each exercise.

What is needed therefore is a modular strength training equipment system that offers many different specialized exercise equipment options in a cost-effective manner while minimizing the facility footprint needed to house the equipment.

SUMMARY

The above and other needs are met by a modular strength training equipment system for providing a plurality of equipment options. The system includes a plurality of base components for forming a plurality of customizable base configurations and a plurality of function mounts. The plurality of base components includes a plurality of posts, a plurality of stabilization legs, and a plurality of junction boxes each including a base receiver, a vertical receiver, and one or more horizontal receivers for removably receiving and arranging the plurality of posts and the plurality of stabilizing legs into the plurality of customizable base configurations. Each of the plurality of function mounts are configured to be selectively secured to at least one of the plurality of customizable base configurations based on a desired equipment option of a user.

According to certain embodiments, the plurality of posts includes at least one base post having a plurality of locking apertures disposed along a length of at least one side of the base post, the base receiver of each of the plurality of junction boxes includes a hollow opening extending through the junction box such that the base post is operable to be inserted through the base receiver of multiple junction boxes when forming one of the plurality of customizable base configurations, and the system further comprises a plurality of locking mechanisms each configured to extend through one of the base receivers of each of the plurality of junction boxes and into one of the plurality of locking apertures of the base post to removably secure the base post to the plurality of junction boxes. In some embodiments, each of the plurality of locking mechanisms include a handle operatively connected to a spring actuated pin wherein each of the plurality of locking mechanisms are secured to one of the base receivers of each of the plurality of junction boxes such that manipulation of the handle withdraws the spring actuated pin from the base receiver for receiving the base post and release of the handle causes the spring actuated pin to be inserted into the base receiver for insertion into one of the plurality of locking apertures of the base post.

According to certain embodiments, the plurality of posts includes posts having varying lengths.

According to certain embodiments, the plurality of posts include one or more base posts, each of the plurality of function mounts include an engaging portion, the base receiver of the plurality of junction boxes are configured to receive the one or more base posts, each of the one or more horizontal receivers of the plurality of junction boxes are configured to receive one of the plurality of stabilization legs, and each of vertical receivers of the plurality of junction boxes are configured to receive the engaging portion of at least a first set of the plurality of function mounts that are intended to be connected directly to one of the plurality of vertical receivers. In some embodiments, the plurality of posts further include one or more vertical posts, each of the vertical receivers of the plurality of junction boxes are configured to receive a proximal end of the one or more vertical posts, and the plurality of function mounts includes a second set of function mounts in which the engaging portion is configured to engage a distal end of the one or more vertical posts. According to some embodiments, the engaging portion of the second set of function mounts is configured to be selectively positioned with respect to the distal end of the one or more vertical posts for adjusting the height of the second set of function mounts.

According to another embodiment of the disclosure, A method for providing a plurality of strength training equipment options includes providing a plurality of base components for forming a plurality of customizable base configurations, the plurality of base components including a plurality of posts and a plurality of junction boxes for removably receiving and arranging the plurality of posts and the plurality of stabilizing legs into the plurality of customizable base configurations; providing a plurality of function mounts, each of the plurality of function mounts configured to be selectively secured to at least one of the plurality of customizable base configurations; offering for selection a plurality of strength training equipment options; assigning one or more of the plurality of function mounts to each of the plurality of strength training equipment options; instructing the user how to form a first base configuration from the plurality of base components based on a first selected strength training equipment option and how to secure the one or more of the plurality of function mounts assigned to the first selected strength training equipment option to the first base configuration; and instructing the user how to form a second base configuration from the plurality of base components based on a second selected strength training equipment option and how to secure the one or more of the plurality of function mounts assigned to the second selected strength training equipment option to the second base configuration.

According to certain embodiments, the plurality of posts includes at least one base post and the plurality of junction boxes each include a base receiver having a hollow opening extending through the junction box such that the at least one base post is operable to be inserted through the base receiver of multiple junction boxes when forming one of the plurality of customizable base configurations.

According to certain embodiments, each of the plurality of posts include a locking aperture and the plurality of junction boxes each include a locking mechanism operable to be removably inserted into the locking aperture of the plurality of posts for removably securing the plurality of posts to the plurality of junction boxes when forming one of the plurality of base configurations. In some embodiments, the locking mechanism includes a handle operatively connected to a spring actuated pin such that manipulation of the handle withdraws the spring actuated pin from the locking aperture of one of the plurality of posts and release of the handle causes the spring actuated pin to be inserted into the locking aperture of one of the plurality of posts.

According to certain embodiments, the plurality of posts includes posts having varying lengths.

According to certain embodiments, the plurality of posts includes one or more base posts, the plurality of junction boxes each include a vertical receiver and a base receiver and the plurality of function mounts each include an engaging portion, the base receiver of each of the plurality of junction boxes is configured to receive the one or more base posts, and the vertical receiver of each of the plurality of junction boxes is configured to receive the engaging portion of at least a first set of the plurality of function mounts that are intended to be connected directly to one of the plurality of vertical receivers. According to some embodiments, the plurality of posts further includes one or more vertical posts, the vertical receiver of each of the plurality of junction boxes is configured to receive a proximal end of the one or more vertical posts, and the plurality of function mounts includes a second set of function mounts in which the engaging portion is configured to engage a distal end of the one or more vertical posts. In some embodiments, the engaging portion of the second set of function mounts is configured to be selectively positioned with respect to the distal end of the one or more vertical posts for adjusting the height of the second set of function mounts.

According to certain embodiments, the base components further include a plurality of stabilization legs, the plurality of posts include one or more base posts, the plurality of junction boxes each include a base receiver, a horizontal receiver, and a vertical receiver, the base receiver configured to receive the one or more base posts and the horizontal receiver configured to receive one of the plurality of stabilization legs when forming the first and second base configurations, and the plurality of function mounts are configured to be selectively secured to the vertical receiver when forming one of the first and second selected strength training equipment options. In some embodiments, the plurality of posts include a vertical post, the vertical receiver of each of the plurality of junction boxes are configured to receive the vertical post, and at least one of the plurality of function mounts is configured to be selectively secured to the vertical receiver when forming one of the first and second selected strength training equipment options by being selectively secured to the vertical post that is received by the vertical receiver.

BRIEF DESCRIPTION OF THE DRAWINGS

Other embodiments of the disclosure will become apparent by reference to the Detailed Description in conjunction with the figures, wherein elements are not necessarily to scale so as to more clearly show the details, wherein like reference numbers indicate like elements throughout the several views, and wherein.

DETAILED DESCRIPTION

The present disclosure is directed to a modular strength training equipment system in which the base components of the system are easily customizable into any number of different base configurations. Many different specialized training equipment options may be formed from the same base components using different function mounts as described further below. In many embodiments, and as depicted herein, the specialized training equipment options are intended to be stand-alone pieces of equipment. However, it should also be understood that certain function mounts could be developed for utilization with the base components to modify or otherwise add a new strength exercise to an existing system within the teachings of the present disclosure (e.g., the base components and a function mounts could be utilized as an attachment to an existing exercise rack or cable system to add a new/additional strength exercise to the existing system).

Figure 1:
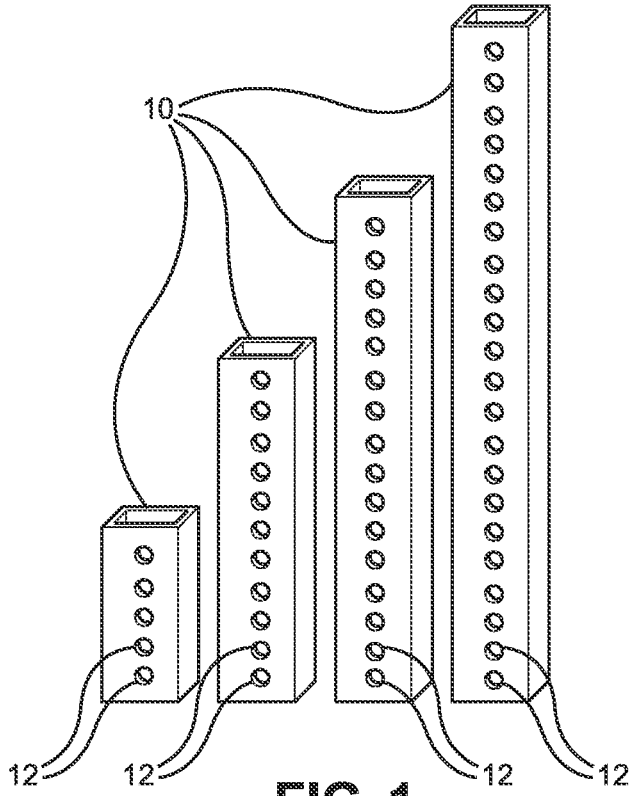
FIG. 1 depicts a plurality of posts for the modular strength training equipment system according to one embodiment of the disclosure.

With reference to FIG. 1, the base components of the modular training system include a plurality of posts 10 each having a plurality of locking apertures 12 disposed along the length of at least one side of the posts. In preferred embodiments, the plurality of posts 10 are provided in varying lengths as depicted in FIG. 1. Certain posts of the plurality of posts 10 may also be referred to as base posts, horizontal posts, or vertical posts based on intended usage in forming a base configuration as described herein. In certain embodiments, the base posts, horizontal posts, and/or vertical posts may vary in features other than just length. However, in preferred embodiments, the posts are substantially the same such that they can be used in different intended usages as needed (e.g., base post could also be used as a horizontal post or a vertical post).

Figure 2:
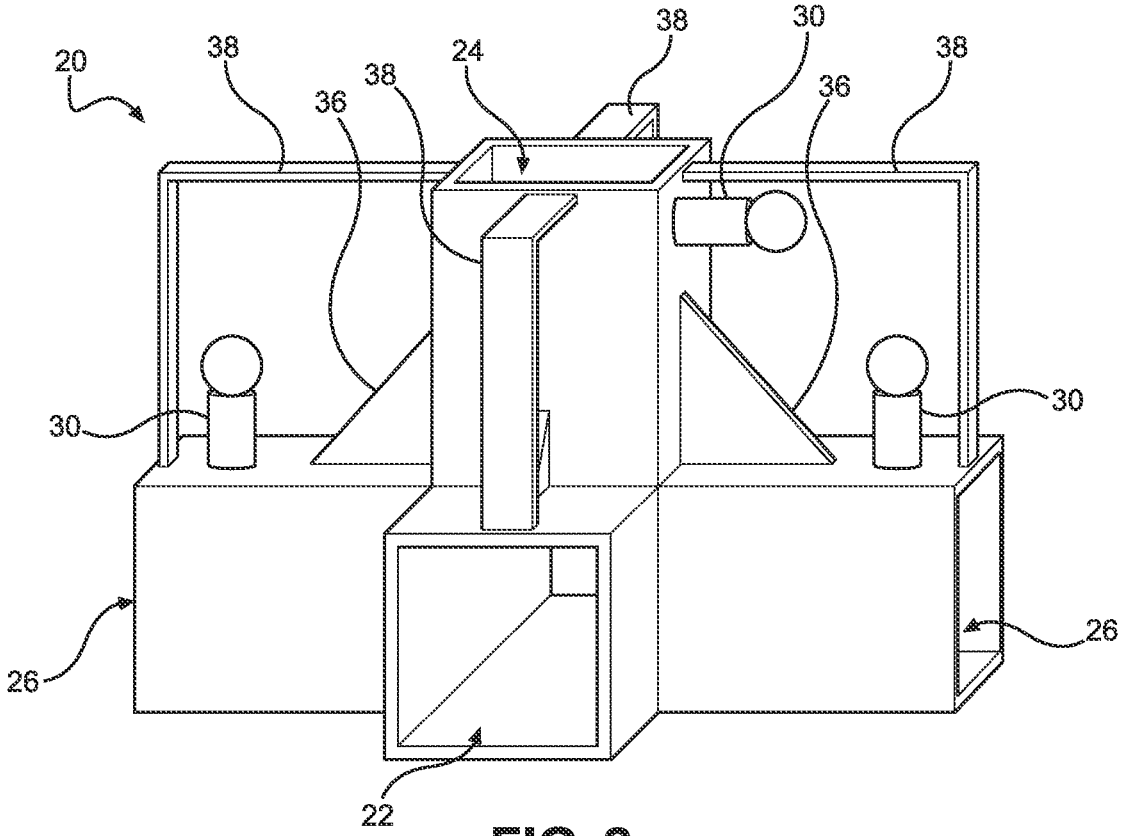
FIG. 2 depicts a junction box for the modular strength straining equipment system according to one embodiment of the disclosure.
Figure 4:
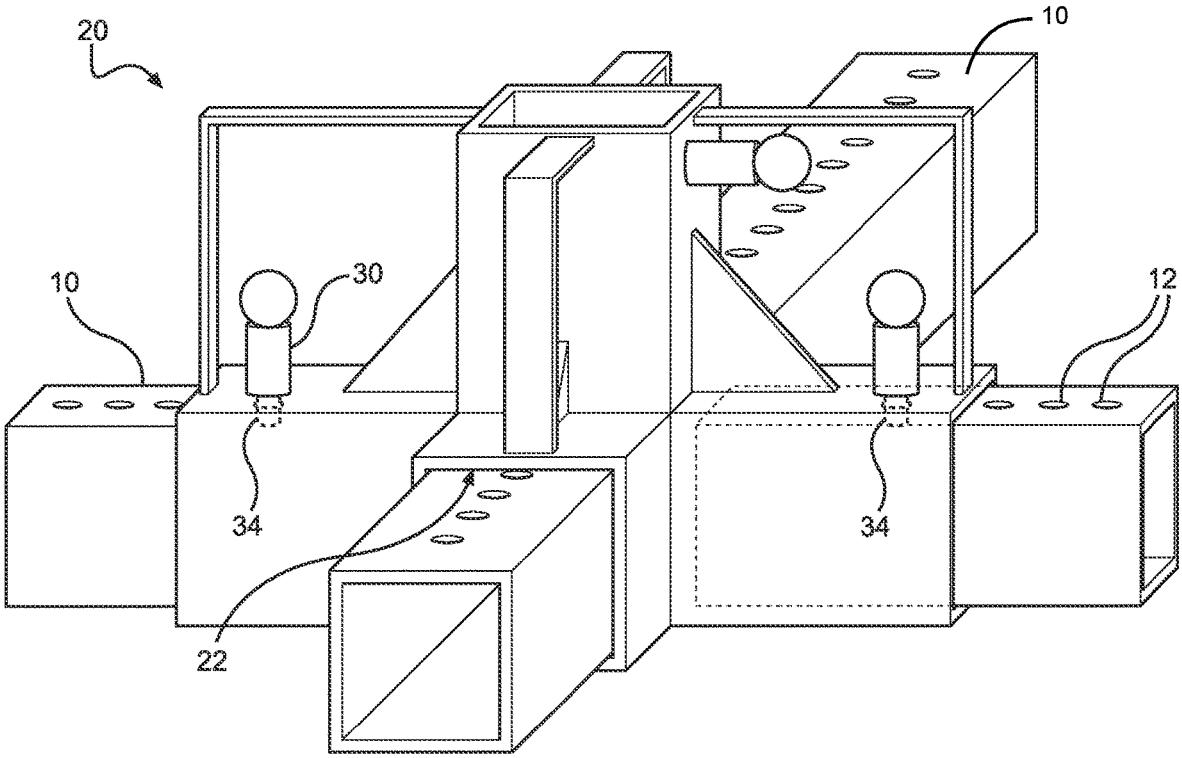
FIG. 4 depicts a junction box receiving a base post according to one embodiment of the disclosure.
Figure 6:
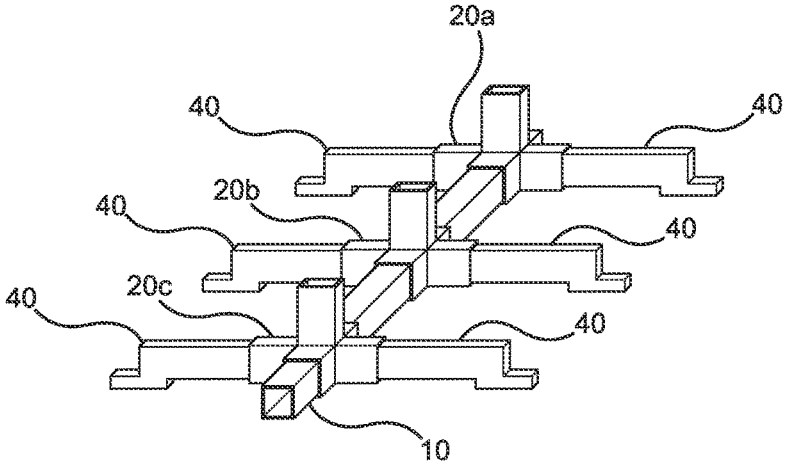
FIG. 6 depicts stabilization legs inserted into the horizontal receivers of the plurality of junction boxes of FIG. 5 in a second step of forming the base configuration according to one embodiment of the disclosure.
Figure 7:
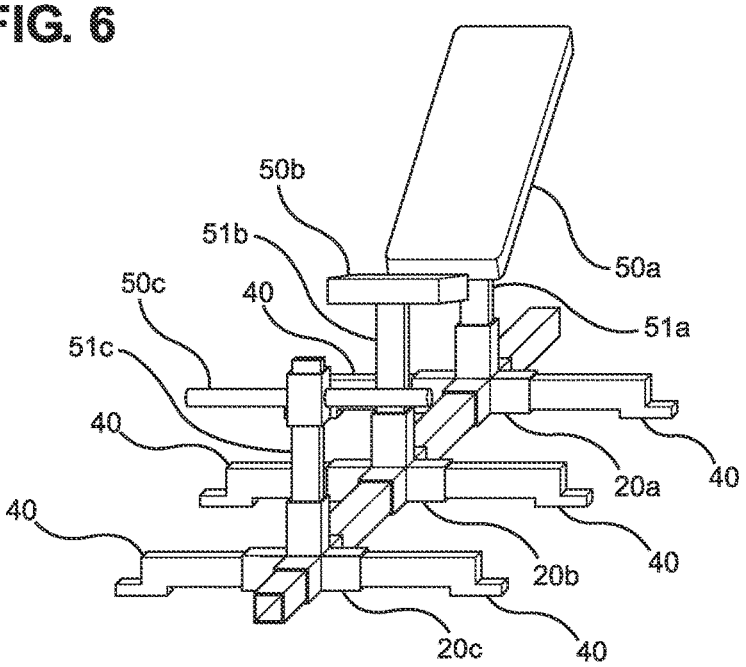
FIG. 7 depicts function mounts inserted into the vertical receivers of the plurality of junction boxes of FIGS. 5-6 to form a specialized piece of strength training equipment according to one embodiment of the disclosure.
Figure 10:
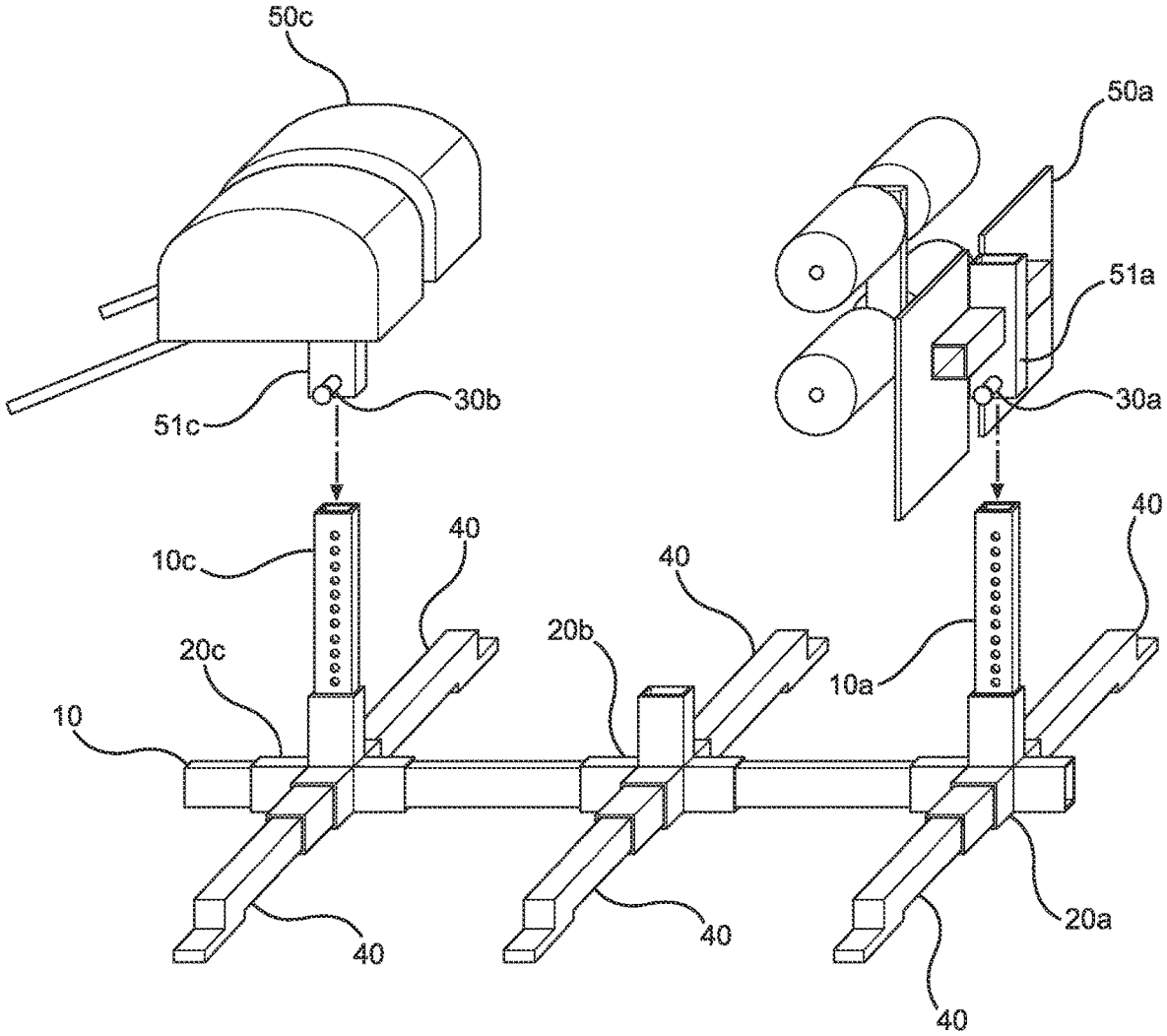
FIG. 10-12 depict the base configuration of FIG. 6 being used to form different specialized pieces of strength training equipment as compared to FIG. 7 using different function mounts.

With reference to FIG. 2, the base components of the modular training system further include a plurality of junction boxes 20 for receiving and joining the posts 10 into any number of different base configurations. The plurality of junction boxes 20 preferably includes junction boxes as depicted in FIG. 2 that include a base receiver 22 for typically receiving a base post 10 (as depicted in FIG. 4), a vertical receiver 24 for typically receiving a vertical post 10 (as depicted in FIG. 10) or a function mount 50 (as depicted in FIG. 7), and one or more horizontal receivers 26 for typically receiving a horizontal post (as depicted in FIG. 4) or a stabilization leg 40 (as depicted in FIG. 6). The base components of the modular training system may further include junction boxes 20 with different configurations of receivers 22, 24, and/or 26 such that junction boxes 20 may be selected as needed depending on the desired base configuration being formed. For example, a junction box 20 intended to receive only the base post 10 and stabilization legs 40 could omit the vertical receiver 24.

Figure 3:
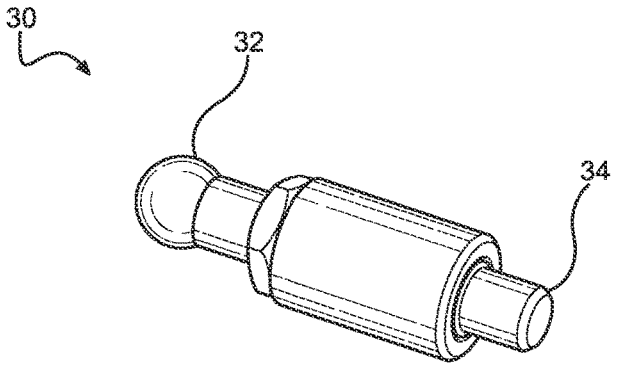
FIG. 3 depicts a spring-actuated locking pin according to one embodiment of the disclosure.

As depicted herein, posts 10 may be inserted into the receivers 22, 24, or 26 either horizontally or vertically to form different base configurations typically using two or more junction boxes 20. To removably secure the posts 10 to the junction boxes 20, each of the receivers 22, 24, or 26 include a locking mechanism 30. In operation, and as depicted in FIG. 4, the appropriate aperture 12 of a post 10 is aligned with the locking mechanism 30 of the appropriate receiver 22, 24, or 26 of the junction box 20. The locking mechanism 30 is then inserted through the into the aperture 12 of the post 10 to secure the post 10 in position with respect to the junction box 20. In preferred embodiments, and with reference to FIGS. 2-4, the locking mechanism 30 according to certain embodiments is in the form of a locking pin having a handle 32 operatively connected to a spring actuated pin 34. According to this embodiment, and as depicted in FIG. 4, the locking mechanism 30 is welded or otherwise secured to an aperture of the junction box 20 such that the pin 34 extends into the receiver 22, 24, or 26 of the junction box 20 in its resting position. To secure a post 10 to the junction box 20, the handle 32 is raised/manipulated to withdraw the pin 34 from the receiver 22, 24, or 26; the post 10 is inserted into the receiver 22, 24, or 26 such that the pin 34 is aligned with the appropriate aperture 12 of post 10; and the handle 32 is released such that the pin 34 is lowered back into the receiver 22, 24, or 26 such that it is also inserted into the aligned aperture 12 of the post 10.

According to other embodiments, the width of the posts 10 and receivers 22, 24, or 26 may be configured such that the receivers 22, 24, or 26 are inserted into the ends of the posts 10 (i.e., the opening of the posts 10 are positioned around the exterior surface of the receivers 22, 24, 26). Thus, for purposes of the present disclosure, a receiver 22, 24, or 26 being "configured to receive" a post (or other component such as a stabilization leg 40) is intended to refer to either the post 10 being inserted into the receiver 22, 24, or 26 or the post 10 being positioned around the exterior of the receiver 22, 24, or 26.

According to certain embodiments, and with reference to FIGS. 2 and 4, the junction box 20 may further include stabilizers 36 to provide additional support to the receivers 22, 24, and/or 26. Covers 38 may also be provided to cover or otherwise obstruct the locking mechanisms 30 to help prevent unintentional unlocking of the locking mechanisms 30 with respect to the posts 10. It should be understood that the locking mechanisms 30, stabilizers 36, and covers 38 as depicted in FIGS. 2 and 4 are merely exemplary. Many other forms of these components are contemplated and intended to be within the scope of the present disclosure. In particular, the locking mechanism 30 described herein could be implemented in many different forms. However, locking mechanism 30 is preferably hand operated such that the components of the present system can be easily interchanged without requiring additional tools such as wrenches, sockets, screwdrivers, etc.

Figure 5:
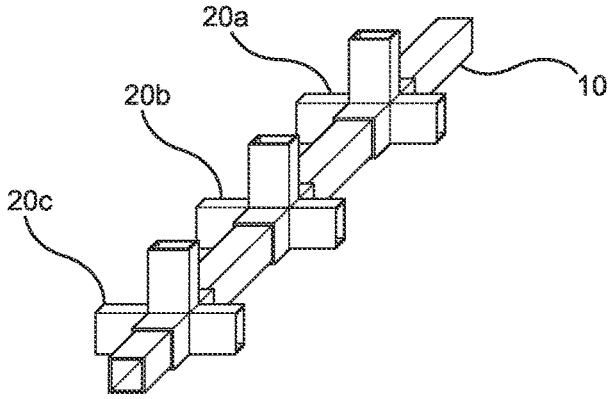
FIG. 5 depicts a base post inserted through the base receivers of a plurality of junction boxes in a first step of forming a base configuration of the modular strength training equipment system according to one embodiment of the disclosure.

With reference to FIGS. 5-7, an exemplary process is depicted for using the posts 10 and junction boxes 20 to first form a base configuration (FIGS. 5-6) and then adding function mounts (FIG. 7) to form an inclined bench with stabilizer legs. For the sake of simplicity, it is noted that the apertures and locking mechanisms 30 as described above have been omitted from the posts 10, junction boxes 20, and stabilizer legs 40. First, with reference to FIG. 5, a base post 10 is inserted through the base receivers 22 of three junction boxes 20*a*, 20*b*, 20*c*. According to this embodiment, and as depicted in FIG. 2, the base receiver 22 of each junction box 20*a*, 20*b*, 20*c* preferably includes a hollow opening that extends lengthwise through the entire base receiver 22. Thus, one of the posts 10 may be inserted entirely through the base receiver 22 for connecting to other junction boxes 20 when forming the desired base configuration. In alternate embodiments, the junction boxes 20 include a solid core such that multiple posts 10 would be needed to form a base configuration.

Figure 8:
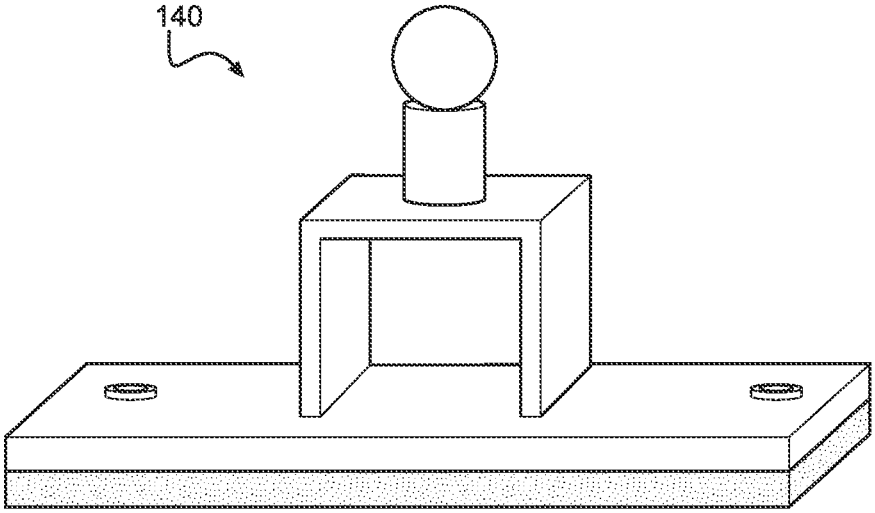
FIG. 8 depicts another embodiment of a stabilization leg according to one embodiment of the disclosure.
Figure 9:
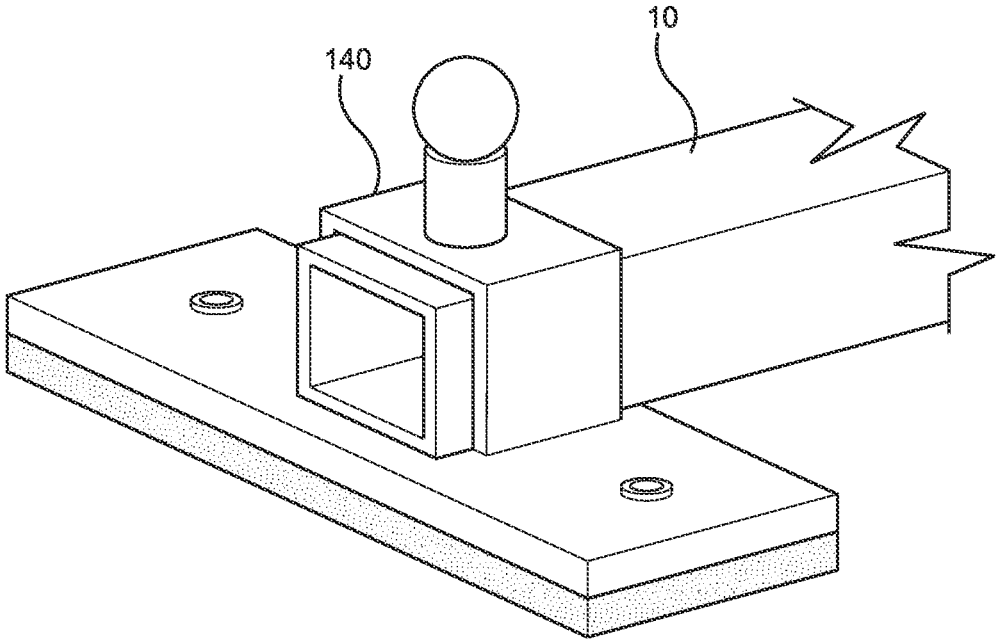
FIG. 9 depicts the stabilization leg of FIG. 8 secured to an end of a base post according to one embodiment of the disclosure.

With reference to FIG. 6, the base components may further include stabilization legs 40 to assist in stabilizing the base configuration of FIG. 5. As shown, the stabilization legs 40 of this embodiment are inserted into the horizontal receivers 26 of the junction boxes 20*a*, 20*b*, and 20*c*. The stabilization legs 40 could take many forms within the teachings of the present disclosure, and the stabilization legs 40 of FIG. 5 are merely exemplary. For example, with reference to FIGS. 8-9, another embodiment of a stabilization leg 140 is depicted. According to this embodiment, stabilization leg 140 is configured to be secured directly to the aperture of a base post 10 instead of in the horizontal receivers 26 of a junction box. In certain embodiments, the plurality of junction boxes 20 provided with the system could also include some junction boxes 20 with stabilization legs already included as part of the junction box itself. For example, a stabilization leg could be welded directly to the bottom of certain junction boxes.

With reference to FIG. 7, once the desired base configuration is constructed, the specialized piece of exercise equipment is then formed by attaching appropriate function mounts 50 to the base configuration. In this example, the function mounts 50 include an inclined bench 50*a* secured to the vertical receiver 24 of junction box 20*a*, a seat 50*b* secured to the vertical receiver 24 of junction box 20*b*, and a leg stabilizer 50*c* secured to the vertical receiver 24 of junction box 20*c*. As depicted in FIG. 7, the function mounts 50*a*, 50*b*, 50*c* each include an engaging portion 51*a*, 51*b*, 51*c* that is configured to be received directly by the vertical receiver 24 of an appropriate junction box. As exemplified in this bench embodiment, forming a desired piece of exercise equipment will often require multiple function mounts 50 to be attached to the same base configuration.

With reference to FIG. 10, another exemplary equipment option in the form of a glute ham machine may constructed from posts 10, junction boxes 20*a*, 20*b*, and 20*c*, and function mounts 50 utilizing a similar base configuration as depicted in FIG. 6. As shown, the base configuration of FIG. 6 is further modified to include vertical post 10*a* that is inserted into the vertical receiver 24 of junction box 20*a* and a vertical post 10*c* that is inserted into the vertical receiver 24 of junction box 20*c*. Function mount 50*a* in the form of a foot stabilization unit for a glute ham machine includes an engaging portion 51*a* that is configured to be secured to vertical post 10*a* at a desired height using locking mechanism 30*a* while function mount 50*c* in the form of the waist support of the glute ham machine includes an engaging portion 51*c* configured to be secured to vertical post 10*c* using locking mechanism 30*b* at a corresponding height. The height of the function mounts 50*a* and 50*c* are adjustable by selecting the desired locking aperture 12 of the vertical posts 10 in which to secure the particular function mount.

Figure 11:
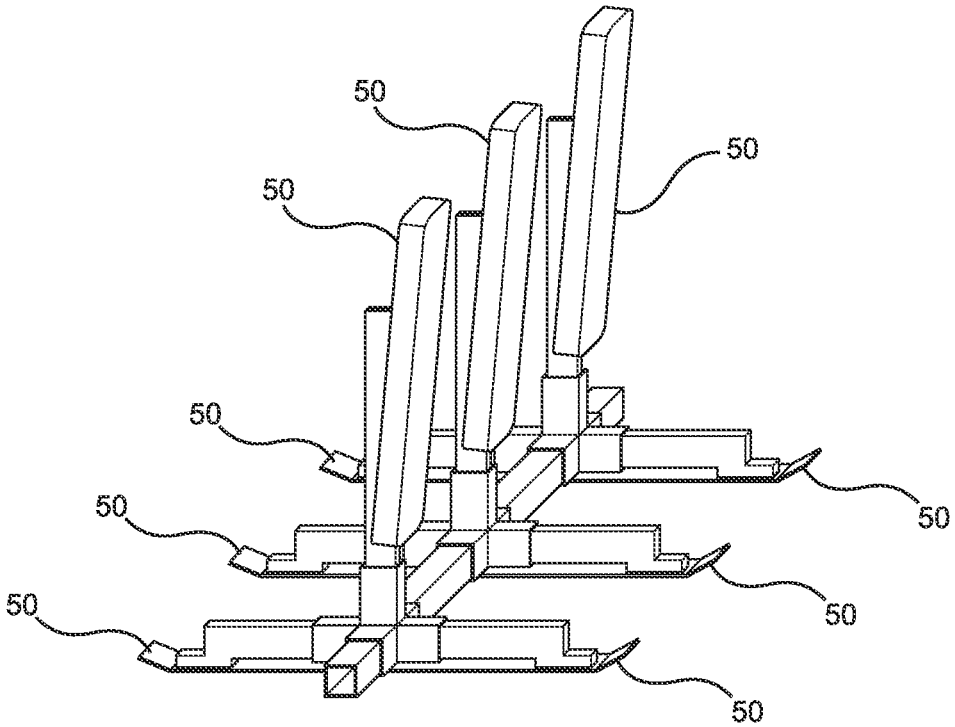
Figure 12:
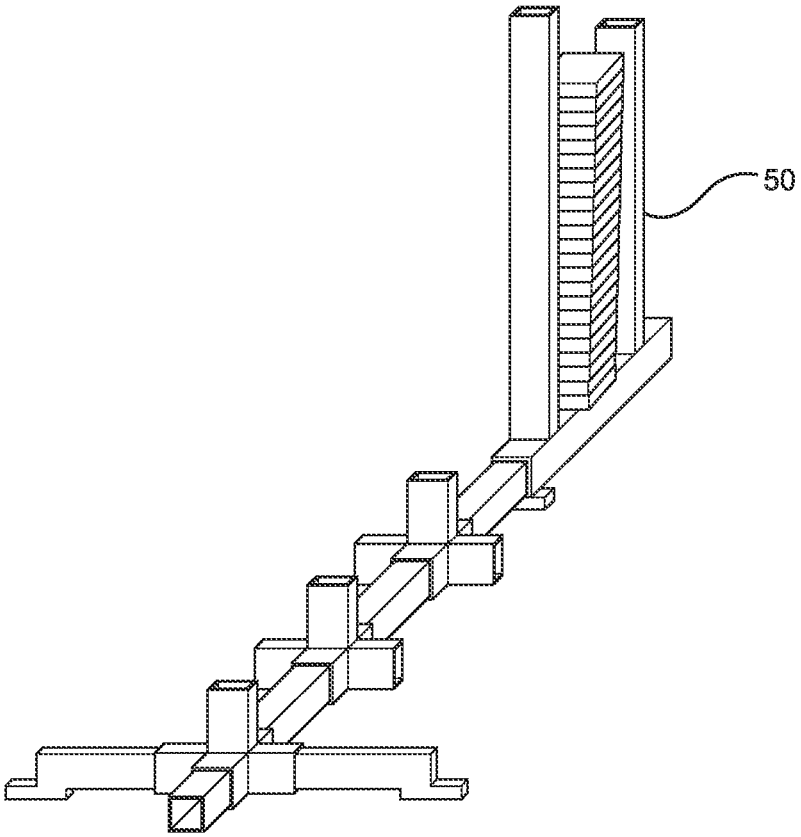
Figure 13:
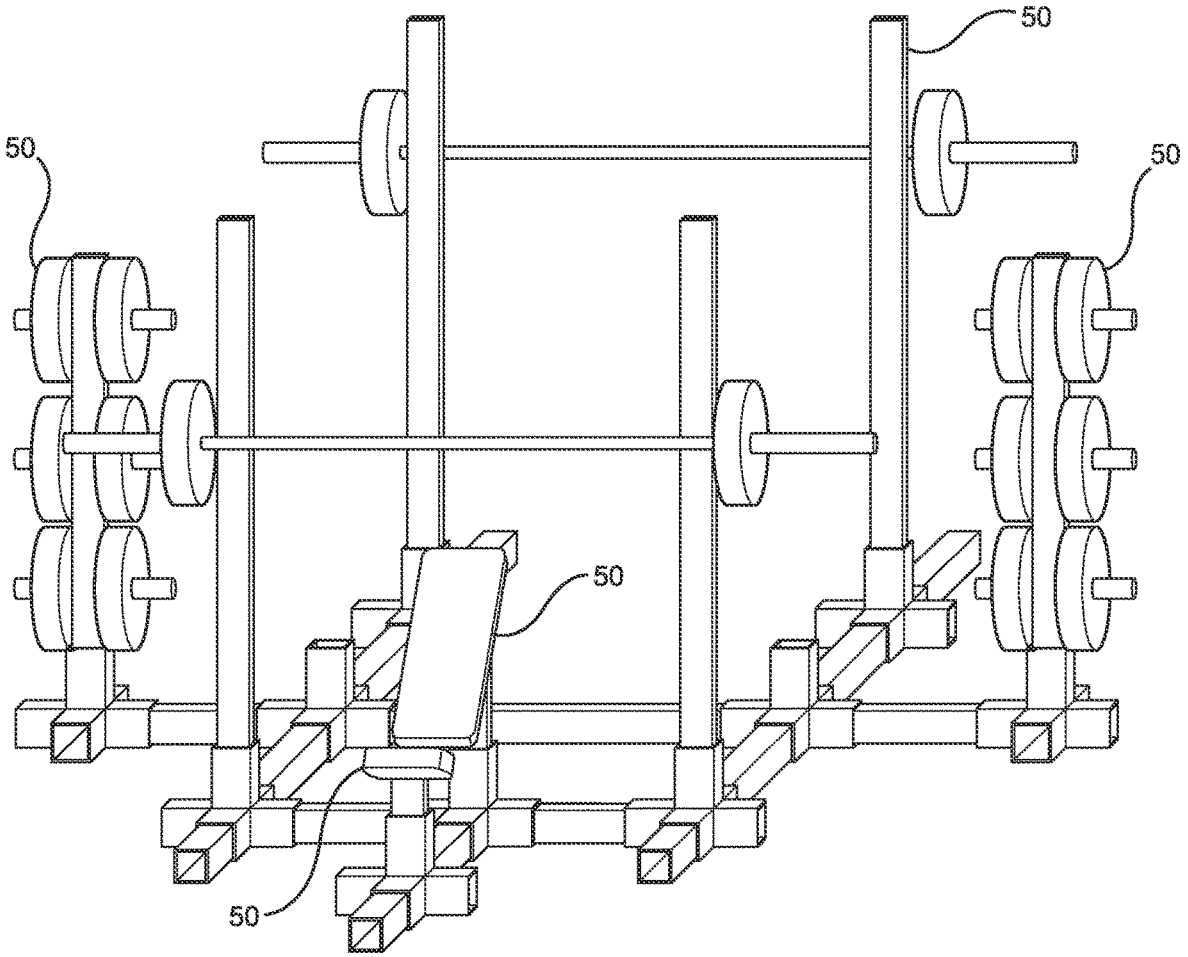
FIG. 13 depicts a power rack formed from components of the modular strength straining equipment system as described herein or the equipment system described herein being used to expand an existing power rack.

Any number of base configurations and corresponding function mounts 50 are contemplated and within the scope of the present disclosure. Additional examples of specialized equipment or components thereof are provided in FIGS. 11-13. FIG. 11 is an example of a football sled (with stabilization legs being substituted for function mounts in the form of sled type legs). FIG. 12 is an example of weight stack system that could be added to other components/equipment and joined by a cable for adding weight resistance to a particular exercise. FIG. 13 is an example of a power rack either being formed by the components described herein or various function mounts 50 (bench and weight racks) being used to expand an existing power rack.

As exemplified by the embodiments shown herein, one of the main advantages of the modular system of the present disclosure is that users have the option of using the same base components to form different pieces of equipment by reconfiguring the base components into different base configurations and then attaching the appropriate function mounts 50 based on the desired piece of equipment. For example, the modular system of the present disclosure could be initially sold with a package containing posts 10 of varying lengths, junction boxes 20, and stabilization legs 40. The purchaser could then decide which types of exercise equipment options is desired. The function mounts 50 are then sold for creating the desired pieces of exercise equipment with detailed instructions (e.g., manuals, videos, charts, etc.) provided to create the needed base configuration from the posts 10, junction boxes 20, and/or stabilization legs 40. When the user wants to add a new piece of equipment, it only needs to purchase the necessary function mounts 50 assuming the user already possesses the needed base components to create the base configuration. Similarly, the same function mounts 50 (such as benches) may be used in creating different pieces of equipment when combined with different function mounts 50. Further, many of the same base configurations could be used to create different pieces of equipment just by interchanging one or more of the function mounts 50. As previously noted, the components of the present disclosure could also be used to add new exercises to existing exercise systems.

Another example of the benefits of the present disclosure is that an entire "gym" could be quickly retrofitted for a particular workout/class. For example, a high school weight room with limited space could initially be set up for a football team workout focusing on a first set of exercises that day. After the football team workout is completed, the same equipment can be quickly modified within the same weight room for a different team focusing on different types of exercises. This is both less expensive by forming different pieces of equipment using interchangeable parts as well saving space in situations where space is limited.

It is further noted that the present system is intended to offer or otherwise complement various types of exercises including free weight, body weight, pin-select stack, plate loaded, resistance band, etc. based on the function mounts 50 selected. As depicted herein, the base components and function mounts 50 may be adjustable in length, widths, angles, heights, etc. to set up virtually any type of specialized exercise equipment. Further, the function mounts 50 themselves can provide individual adjustments to accommodate different size and preferences of the users by including telescoping tubing such as with respect to the post 10 or vertical receiver 24 in which the function mount 50 is secured.

The foregoing description of preferred embodiments for this disclosure have been presented for purposes of illustration and description. They are not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by any future claims when interpreted in accordance with the breadth to which they are fairly, legally, and equitably entitled.

What is claimed is:

1. A method for providing a plurality of strength training equipment options, the method comprising:

providing a plurality of base components for forming a plurality of customizable base configurations, the plurality of base components including a plurality of posts and a plurality of junction boxes for removably receiving and arranging the plurality of posts into the plurality of customizable base configurations;

providing a plurality of function mounts, each of the plurality of function mounts configured to be selectively secured to at least one of the plurality of customizable base configurations;

offering for selection a plurality of strength training equipment options;

assigning one or more of the plurality of function mounts to each of the plurality of strength training equipment options;

instructing the user how to form a first base configuration from the plurality of base components based on a first selected strength training equipment option and how to secure the one or more of the plurality of function mounts assigned to the first selected strength training equipment option to the first base configuration; and instructing the user how to form a second base configuration from the plurality of base components based on a second selected strength training equipment option and how to secure the one or more of the plurality of function mounts assigned to the second selected strength training equipment option to the second base configuration.

2. The method of claim 1 wherein:

the plurality of posts include one or more base posts, the plurality of junction boxes each include a vertical receiver and a base receiver and the plurality of function mounts each include an engaging portion, the base receiver of each of the plurality of junction boxes is configured to receive the one or more base posts, and the vertical receiver of each of the plurality of junction boxes is configured to receive the engaging portion of at least a first set of the plurality of function mounts that are intended to be connected directly to one of the vertical receivers.

3. The method of claim 2 wherein:

the plurality of posts further include one or more vertical posts, the vertical receiver of each of the plurality of junction boxes is configured to receive a proximal end of the one or more vertical posts, and the plurality of function mounts includes a second set of function mounts in which the engaging portion is configured to engage a distal end of the one or more vertical posts.

4. The method of claim 3 wherein the engaging portion of the second set of function mounts is configured to be selectively positioned with respect to the distal end of the one or more vertical posts for adjusting a height of the second set of function mounts.

5. The method of claim 1 wherein each of the plurality of posts include a locking aperture and the plurality of junction boxes each include a locking mechanism operable to be removably inserted into the locking aperture of the plurality of posts for removably securing the plurality of posts to the plurality of junction boxes when forming one of the plurality of base configurations.

6. The method of claim 5 wherein the locking mechanism includes a handle operatively connected to a spring actuated pin such that manipulation of the handle withdraws the spring actuated pin from the locking aperture of one of the plurality of posts and release of the handle causes the spring actuated pin to be inserted into the locking aperture of one of the plurality of posts.

7. The method of claim 1 wherein:

the base components further include a plurality of stabilization legs, the plurality of posts include one or more base posts, the plurality of junction boxes each include a base receiver, a horizontal receiver, and a vertical receiver, the base receiver configured to receive the one or more base posts and the horizontal receiver configured to receive one of the plurality of stabilization legs when forming the first and second base configurations, and the plurality of function mounts being configured to be selectively secured to the vertical receiver when forming one of the first and second selected strength training equipment options.

8. The method of claim 7 wherein the plurality of posts include a vertical post, the vertical receiver of each of the plurality of junction boxes being configured to receive the vertical post, and at least one of the plurality of function mounts is configured to be selectively secured to the vertical receiver when forming one of the first and second selected strength training equipment options by being selectively secured to the vertical post that is received by the vertical receiver.

9. The method of claim 1 wherein the plurality of posts includes at least one base post and the plurality of junction boxes each include a base receiver having a hollow opening extending through the junction box such that the at least one base post is operable to be inserted through the base receiver of multiple junction boxes when forming one of the plurality of customizable base configurations.

10. The method of claim 1 wherein the plurality of posts include posts having varying lengths.

* * * * *